US005801625A

United States Patent [19]

Wang

[11] Patent Number: 5,801,625

[45] Date of Patent: Sep. 1, 1998

[54] AUXILIARY CONTROL DEVICE FOR SECURITY ALARM SYSTEM

[76] Inventor: Randall Wang, 5209 N. Tyler Ave., Temple City, Calif. 91780

[21] Appl. No.: 835,124

[22] Filed: Apr. 4, 1997

[51] Int. Cl.[6] ..... G08B 29/00

[52] U.S. Cl. ..... 340/506; 340/565; 340/527; 340/528; 340/541; 340/825.06; 340/825.31

[58] Field of Search ..... 340/506, 521, 340/528, 529, 541, 542, 545, 552, 565, 825.06, 825.31, 309.15, 692; 250/221, 222.1

[56] References Cited

U.S. PATENT DOCUMENTS 5,532,680 7/1996 Ousborne ..... 340/567

5,640,141 6/1997 Myllymaki ..... 340/506

*Primary Examiner*—Jeffery Hofsass

*Assistant Examiner*—Daryl C. Pope

*Attorney, Agent, or Firm*—David & Raymond; Raymond Y. Chan

[57] ABSTRACT

An auxiliary control device for a security alarm system installed in a commercial facility includes a control circuit for bypassing the electrical connection between the alarm control panel and the security devices of the security alarm system during business hour and automatically setting the security alarm system to a standby condition at the close time of the commercial facility. At that standby condition, the auxiliary control device activates the door lock control to lock the entrance or exit door but the electrical connection between the alarm control panel and some of the security devices still remains bypassing to deactivate the alarm buzzer when any human activity of the customers inside the commercial facility is detected by the motion detectors of the security alarm system. Moreover, when a leaving customer is detected by a door sensor of the exit door, the auxiliary control device will activate the door lock control to unlock the exit door for a predetermined period of time automatically. The auxiliary control device can automatically control the security alarm system to switch to the disarming condition, standby condition and arming condition.

17 Claims, 6 Drawing Sheets

AUXILIARY CONTROL DEVICE FOR SECURITY ALARM SYSTEM

BACKGROUND OF THE PRESENT INVENTION

The present invention relates to security alarm systems, and more particularly to an auxiliary control device which is an intelligent control device installed between an alarm control panel and a plurality of predetermined security devices, such as motion detectors, door lock controls and alarm buzzers, of a security alarm system. The present invention is designed for incorporating with the original security alarm system installed in commercial facilities where automatic security and door control are preferred, and for modifying the conventional security alarm system to form a fully automatically controlled system.

Most commercial facilities have installed security alarm systems to monitor the facilities from burglars. Conventional security alarm system generally comprises an alarm control panel to control a plurality of security devices, such as motion detectors for detecting any unwanted human activity within the monitoring areas, window motion sensors for detecting any damage thereof, door lock controls for locking all the doors after business hour, and alarm buzzers for providing buzzing alarm when burglar breaks in the monitoring area. Normally the conventional security alarm system is in disarming condition during the business hour. The user can switch the security alarm system to an arming condition by setting a control key pad or a remote control of the control panel to activate all the security devices after the business hour. When the facility is re-opened the next day, the user can switch off (disarmed) the alarm system by setting the control key pad or remote control. To some commercial facilities, their security alarm systems are programmed for automatically presetting the security alarm systems be disarmed (in disarming condition) for a predetermined period of time, for example during the business hour.

No matter the manual or automatic controlling method as mentioned above is used for controlling the conventional security alarm system, some commercial facilities such as multi-user business offices, self service stores and coin-op self service Laundromats are suffered in the following inconvenience.

For example, the coin-op Laundromat is a traditional self service commercial facility that the security alarm system can only be armed after the last customer has left the Laundromat. In the other words, it is impossible to force all the customers to leave the Laundromat before a predetermined regular close time and to preset the security alarm system to be automatically activated to the arming condition at that regular close time. The only solution is that at least a security guard or an employee should be hired at the entrance to refuse late customers after the business hour of the Laundromat and to wait there until the last customer leaves the Laundromat. Then the security guard or the employee must manually set the security alarm system to the arming condition. Moreover, the owner or his employee has to go back to the Laundromat the next business day morning to switch off the security alarm system before the business hour.

SUMMARY OF THE PRESENT INVENTION

The main object of the present invention is to provide an auxiliary control device for a security alarm system installed in a commercial facility, which can bypass an electrical connection between an alarm control panel and a security devices of the security alarm system during business hour, and can automatically set the security alarm system to a standby condition at the close time of the commercial facility. At that standby condition, the auxiliary control device activates the door lock control to lock the entrance and exit doors but the electrical connection between the alarm control panel and some of the security devices still remains bypassing to deactivate the alarm buzzers when any movement of the customers inside the commercial facility is detected by the motion detectors of the security alarm system. Moreover, when a leaving customer is detected by a door sensor of the exit door, the auxiliary control device will activate the door lock control to unlock the exit door for a predetermined period of time automatically. Therefore, the owner or his employee does not need to stay in the commercial facility until the leaving of the last customer after business hour and to set the security alarm system to the arming condition. Also, the owner or his employee does not require to go back the next morning for setting the security alarm system to the disarming condition. The auxiliary control device of the present invention can automatically control the security alarm system to selectively switch to the disarming condition, standby condition and arming condition.

Another object of the present invention is to provide an auxiliary control device which is installed between the output of the alarm control panel and all the security devices of a security alarm system, wherein the auxiliary control device is inexpensive and easy operated.

Another object of the present invention is to provide a process for controlling the timing of switching a security alarm system to the arming condition by monitoring the presence of customers or residents through those motion detectors of the security alarm system.

Accordingly, an auxiliary control device of the present invention is installed between an alarm control panel and a plurality of security devices of a security alarm system arranged in a commercial facility. The plurality of security devices includes at least a plurality of motion detectors installed to monitor a plurality of predetermined monitoring area of the commercial facility respectively, a predetermined number of door lock control and door motion sensor connected to each entrance or exit door of the commercial facility, and a plurality of electrical appliances of the commercial facility.

The auxiliary control device of a security alarm system comprises the following circuitries electrically connected to form a control circuit.

An input driving circuitry is input connected with the plurality of security devices of the security alarm system.

A counter circuitry is adapted for generating pulses and computing a programmed period of predetermined dynamic delay time so as to set the security alarm system to a standby condition that, when the motion detectors of the security alarm system detect any motion occurred during the computing of the period of dynamic delay time, the counter circuitry is activated via the driving circuitry to reset to compute the period of dynamic delay time initially again.

A timing circuitry has a timer clock for sending a signal to activate the counter circuitry to begin the computing of the period of dynamic delay time at a function time preset in the timer clock.

A relay driver circuitry which has a lock control is adapted for ensuring the door lock control to lock a predetermined number of door of the commercial facility during the standby condition A lock releasing circuitry is adapted for activating the door lock control to temporary release the locking of the door for a predetermined period of lock releasing time when any motion is detected by the door motion sensor, which is installed near the door, during the standby condition.

An output circuitry is adapted for output connecting to the control panel of the security alarm system.

An output control circuitry is adapted for circuit bypassing the electrical connection between the control panel and the security devices during a predetermined period of opening time of the commercial facility and the standby condition, and for switching the security alarm system to an arming condition from the standby condition by releasing the circuit bypassing between the control panel and the security devices after the predetermined period of dynamic delay time is computed by the counter circuitry.

A protecting circuitry is adapted for preventing any high potential difference occurred between the input driving circuitry and the output circuitry of the auxiliary control device.

A driver control circuitry is connected to the buzzer and a plurality of electrical appliances of the commercial facility, for deactivating a buzzer and cutting a power supply to the electrical appliances during the standby condition for energy saving.

A display circuitry is adapted for indicating a plurality of status of the security alarm system.

Whereby, before the function time, the auxiliary control device is activated to bypass the electrical connection between the alarm control panel and the plurality of security devices of the security alarm system installed in the commercial facility so as to set the security alarm system to a disarming condition during a predetermined period of time. When the function time preset in the timing circuitry is reached, the timing circuitry activates the counter circuitry beginning to generate pulses and compute the predetermined period of dynamic delay time, wherein the security alarm system is then set to the standby condition.

During the standby condition, the output control circuitry of the auxiliary control device is activated for continuously bypassing the electrical connection between the alarm control panel and the security devices. The driver control circuitry deactivates the buzzer of the security alarm system and cuts off the power supply to the predetermined electrical appliances. The lock control of the relay driver circuitry is activated to lock the door. The motion detectors of the security alarm system detects whether there is any customer inside the commercial facility and resetting the predetermined period of dynamic delay time to compute initially again when any motion of any customer is detected by the motion detectors. The door motion sensor of the security alarm system detects whether there is any customer near the locked door and unlocking the door for the predetermined period of lock releasing time by the lock releasing circuitry when any customer is detected by the door sensor.

After the predetermined period of dynamic delay time is computed by the counter circuitry, the output control circuitry connects the electrical connection between the alarm control panel and the security devices by releasing the bypassing between the alarm control panel and the security devices, in order to set the security alarm system to an arming condition.

DETAILED DESCRIPTION OF THE PREFERRED EMBODIMENT

Figure 1A:
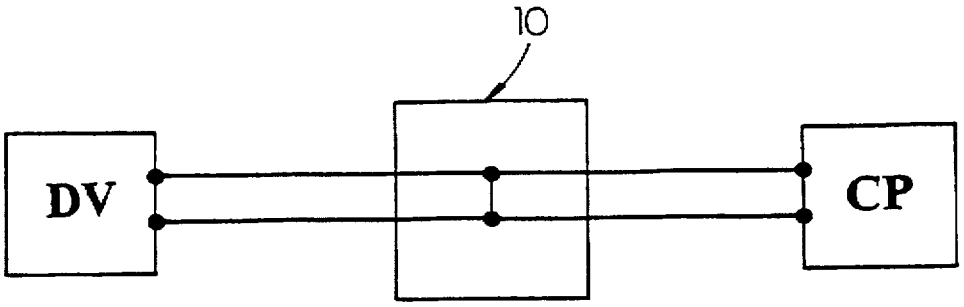
FIGS. 1A to 1C are schematic views illustrating three operating processes of an auxiliary control device for a security alarm system according to the above preferred embodiment of the present invention.
Figure 1B:
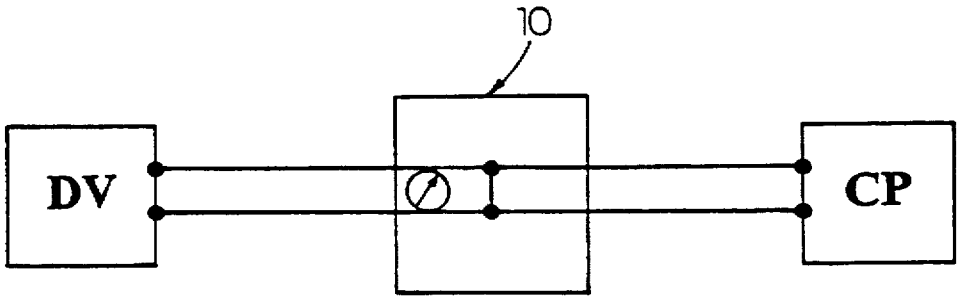
Figure 1C:
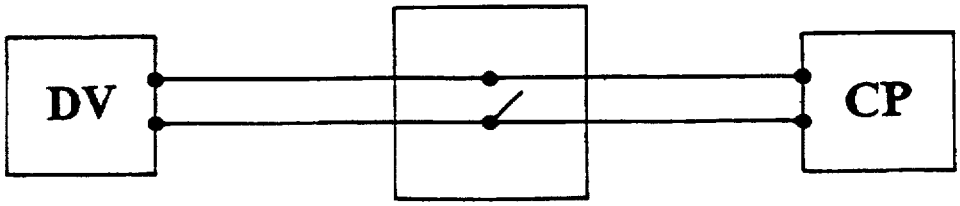

Referring to FIGS. 1A to 1C of the drawings, an auxiliary control device 10 for a security alarm system of the present invention is installed between an alarm control panel CP and a plurality of timer-controlled security devices DV of the security alarm system arranged in a commercial facility such as a multi-user business office, a self service store or a corn-op Laundromat.

Figure 2:
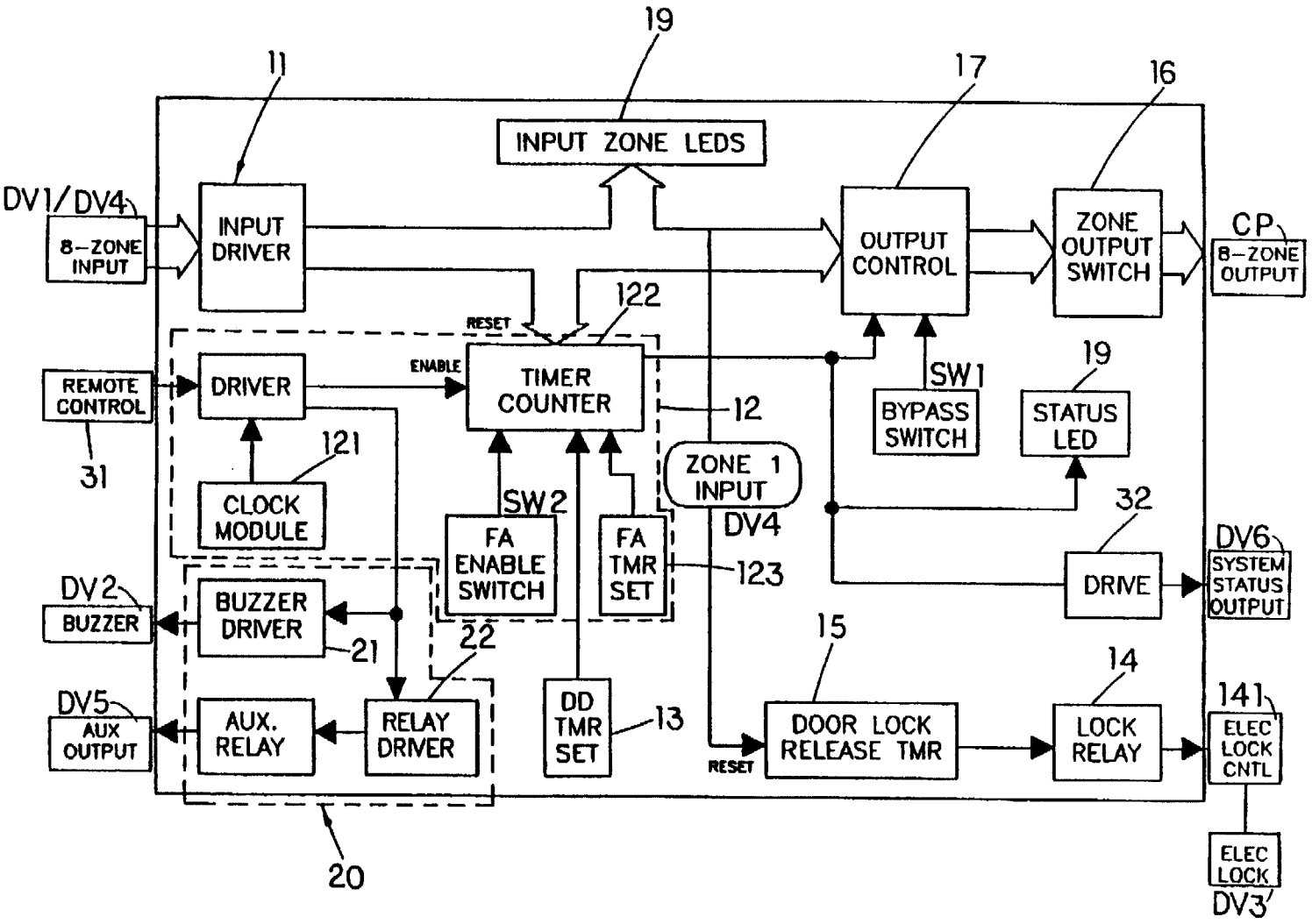
FIG. 2 is a block diagram illustrating the operation of the auxiliary control device for a security alarm system according to a preferred embodiment of the present invention.
Figure 3:
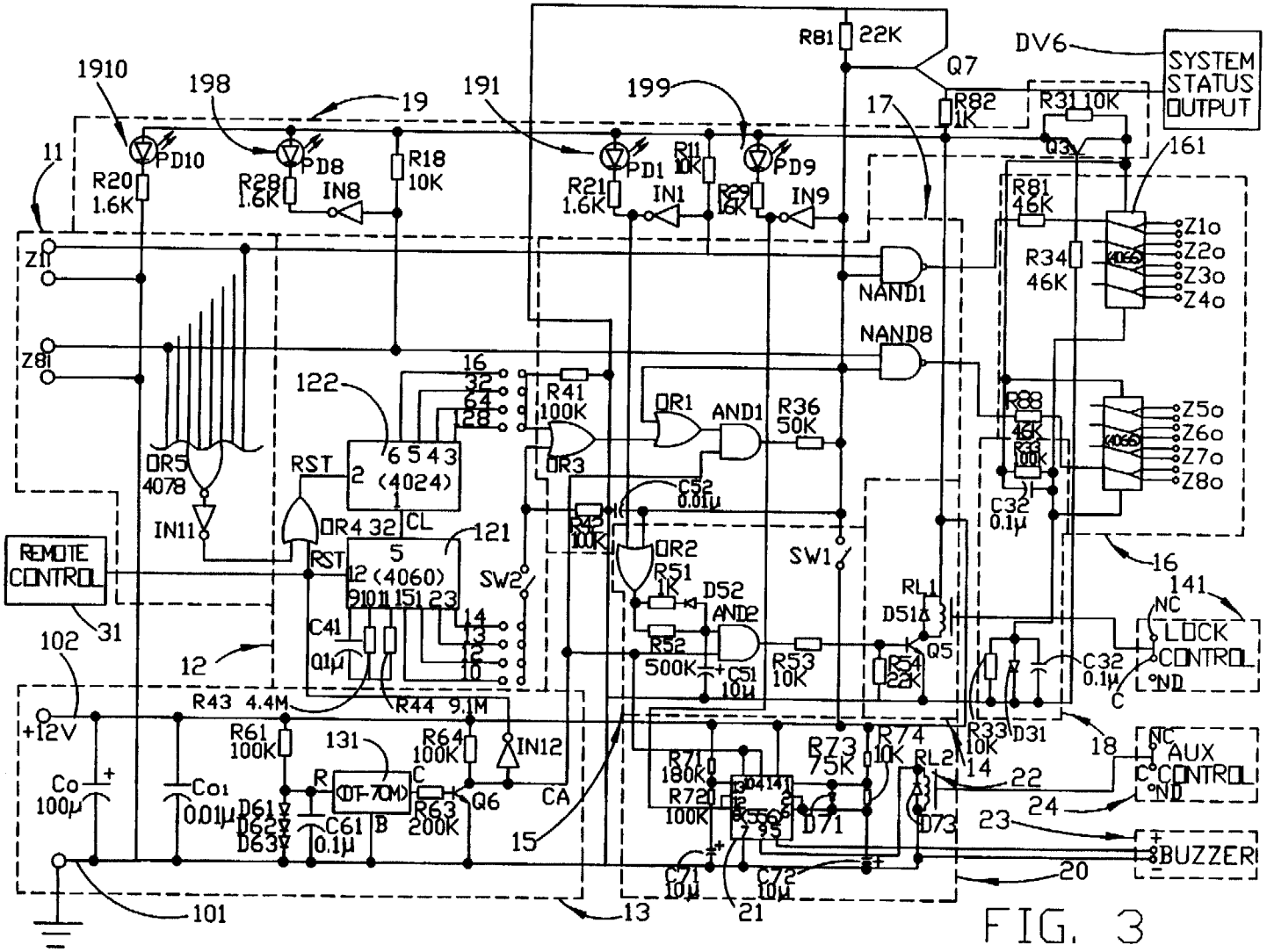
FIG. 3 is a circuit diagram of the auxiliary control device for a security alarm system according to the above preferred embodiment of the present invention.

As shown in FIGS. 2 and 3, the security devices DV includes at least a plurality of motion detectors DV1 respectively installed to a plurality of predetermined monitoring areas of the commercial facility where human activities may occur, at least an alarm buzzer DV2, a predetermined number of electric door locks DV3 and door motion sensors DV4 respectively connected to each entrance or exit door of the commercial facility, and a plurality of electrical appliances DV5 of the commercial facility.

As shown in FIGS. 2 and 3, the auxiliary control device 10 comprises an input driving circuitry 11, a counter circuitry 12, a timing circuitry 13, a relay driver circuitry 14, a door lock releasing circuitry 15, an output circuitry 16, an output control circuitry 17, a protecting circuitry 18, a display circuitry 19, and a driver control circuitry 20 electrically connected to form an entire control circuit as shown in FIG. 3.

The input driving circuitry 11 comprises a predetermined number of input terminal units Z1*i* to Z8*i* that each the input terminal unit is connected in series to a logic gate OR8 and an anti-phase amplifier IN12 for input connecting with a predetermined number of timer controlled security devices DV, such as a plurality of motion detectors DV1 respectively installed in various timer controlled alarm monitoring zones and a plurality of door motion sensors DV4 respectively installed near the plurality of exit doors of the commercial facility (as indicated in FIG. 2).

The counter circuitry 12 comprises a logic gate OR4, a clock module 121, a timer counter 122, and a force arming enable switch SW2, in which the clock module 121 is a pulse generator clock integrate circuit 4060 and the timer counter 122 is a counter integrate circuit 4024 for computing a programmed period of dynamic delay time in the clock integrate circuit 4060. Such dynamic delay time is programmed into the timer counter 122 for generally 5 to 30 minutes. The logic gate OR4 has an input connected to the anti-phase amplifier IN11 and the clock module 121, and an output connected to the timer counter 122. The force arming enable switch SW2 is connected between the clock module 121 and the timer counter 122 for manually activating the counter circuitry 12 to function or deactivating the counter circuitry 12.

Therefore, the counter circuitry 12 generates pulses and computes the programmed period of dynamic delay time during a standby condition, wherein when the motion detectors DV1 detect any motion occurred in the alarm monitoring zones before the end of the computing period of dynamic delay time, a motion signal is sent to the counter circuitry 12 via the driving circuitry 11 to reset the dynamic delay time and to compute initially again.

The timing circuitry 13, for sending a signal to activate the counter circuitry 12 to the standby condition at a preset function time, comprises a capacitor Co connected between a grounded line 101 and a 12V power line 102, a capacitor C01 connected in parallel with the capacitor Co, a resistor R61 connected in series with three diodes D61, D62, D63 and in parallel with the capacitor C01, a timer clock 131 which is a digital programmable timer set DT-7 CM for presetting the function time of the counter circuitry 12. The timer clock 131 has a R end connected to a capacitor C61 which is connected in parallel with the three diodes D61, D62, D63, and a B end connected to the grounded line 101. A G end of the timer clock 131 is connected to a resistor R3 which is connected in series with a transistor Q6. The diode Q6 is connected to a resistor R64 and an input end of an anti-phase amplifier IN12, in which the resistor R64 is further connected to the power line 102 and an output end of the anti-phase amplifier IN12 is connected to the input of the logic gate OR4 and the clock module 121 of the counter circuitry 12.

The relay driver circuitry 14, for ensuring the electric door lock DV3 remained in a locking condition to lock all the entrance and exit doors of the commercial facility during the standby condition, comprises a resistor R54 connected to the grounded line 101 and a transistor Q5 which is connected with a diode D51. The diode D51 is connected in parallel with a relay RL1 which is connected with a lock control 141 for connecting and controlling the corresponding electric door lock DV3 which is either a power-on-released lock or a power-off-released lock of the exit door, as shown in FIG. 5.

The lock releasing circuitry 15 is functioned for activating the corresponding door lock control 141 to temporary release the locking of the electric door lock DV3 of that exit door for a predetermined period of lock releasing time when any motion is detected by the corresponding door motion sensor DV4 installed near that door. The lock releasing circuitry 15 which is a delay circuitry comprises a logic gate AND2 having an output connected to a resistor R53 which is connected with the transistor Q5 and the resistor R54 of the relay driver circuitry 14. An input of the logic gate AND2 is connected to the input of the anti-phase amplifier IN12 and a resistor R52 which is connected in parallel with a resistor R51 and a diode D52, in which the input of the diode D52 is connected to a capacitor C51 which is connected to the grounded line 101. The resistor R51 is connected to an output of a logic gate OR2.

Figure 5:
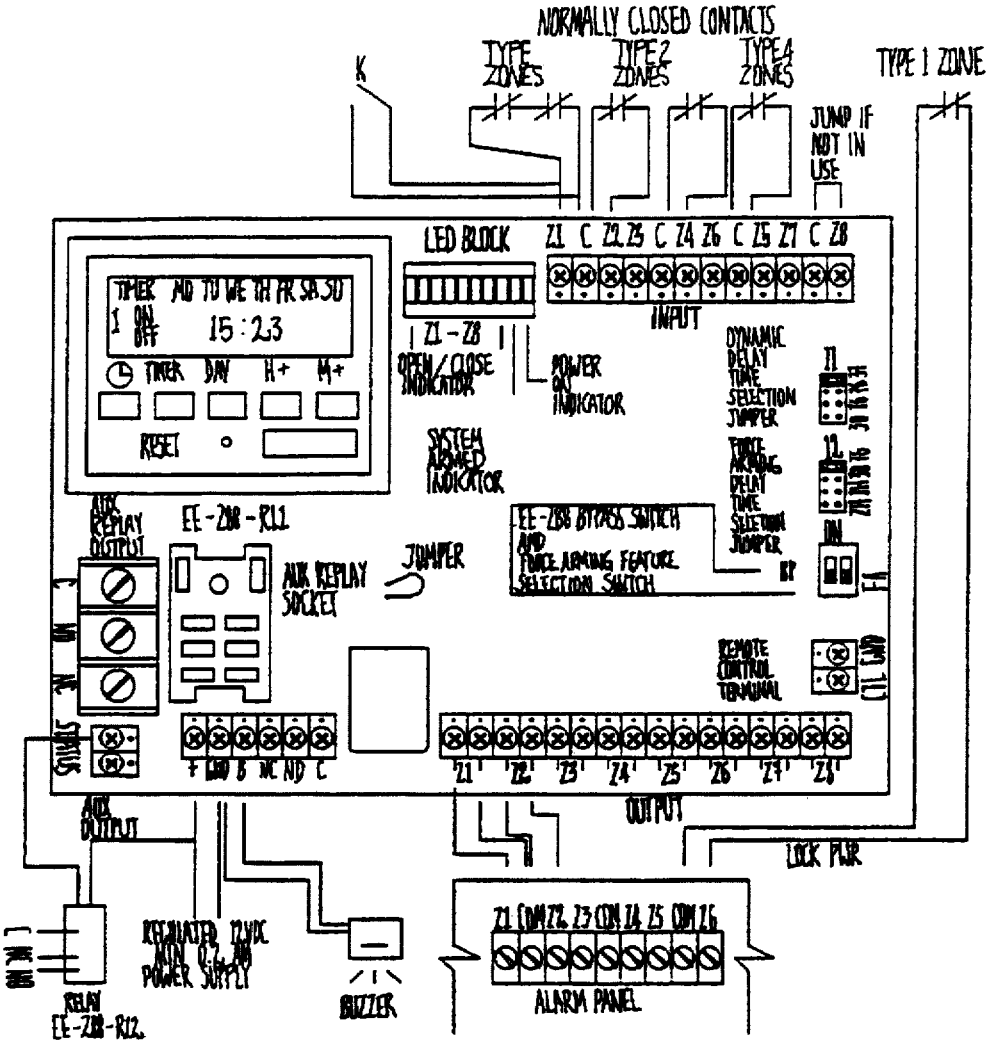
FIG. 5 is a perspective front view of the auxiliary control device for a security alarm system according to the above preferred embodiment of the present invention.
Figure 5:
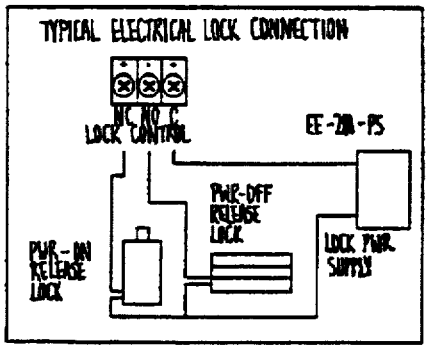
Figure 5:
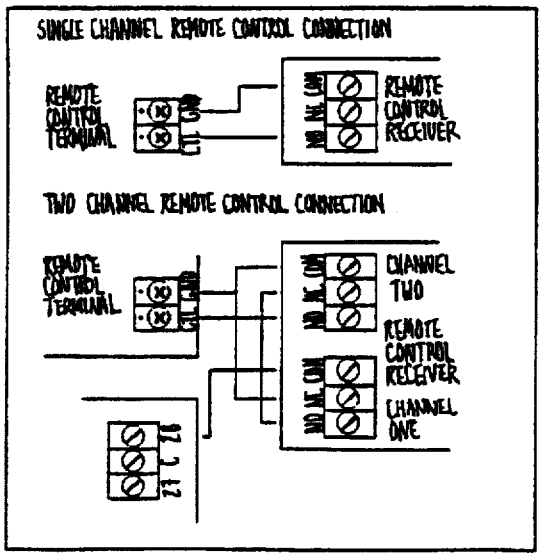

The output circuitry 16, for output connecting to the control panel CP of the security alarm system, comprises two output switches 161, 162 which are two solid state contact integrate circuits 4066 and provide a plurality of output terminal units Z1*o* to Z8*o* for connecting to the input terminal units for security devices DV of the alarm control panel CP, as shown in FIG. 5. The output control circuitry 16 further comprises a plurality of resistors R81 to R88 are connected with the plurality of output terminal units Z1*o* to Z8*o* of the two output switches 161, 162 respectively.

The output control circuitry 17 is functioned for bypassing the electrical connection between the alarm control panel CP and the security devices DV during the business hour and the standby condition, and for switching the security alarm system to an arming condition from the standby condition by releasing the circuit bypassing condition between the control panel CP and the security devices DV after the predetermined dynamic delay time is computed by the counter circuitry 12.

The output control circuitry 17 comprises a plurality of logic gates NAND1 to NAND8, wherein their outputs are connected to the plurality of output terminal units Z1*o* to Z8*o* via the plurality of resistors R81 to R82 respectively while their inputs are connected to the input terminal units Z1*i* to Z8*i* of the input driving circuitry 11 respectively. The inputs of the logic gates NAND1 to NAND8 are further connected in parallel with a logic gate OR1, a logic gate AND1 and a resistor R36. The input of the logic gate OR1 is connected to a logic gate OR3 and the input of the logic gate AND1 is connected to the input of the logic gate AND2 of the lock releasing circuitry 15 and the input of the anti-phase amplifier IN12 of the timing circuitry 13. The first input of the logic gate OR3 is connected to a resistor R41 while the second input of the logic gate OR3 is connected to a resistor R42, a capacitor C52 and a manual bypass switch SW1, in which both the resistors R41 and R42 are connected with the grounded line 101.

The manual bypass switch SW1 is connected with the power line 102, the input of the logic gate OR2, the resistor R36, the inputs of the logic gates NAND1 to NAND8, and the resistor R81, for manually controlling the bypassing feature of the auxiliary control device 10. The user can manually switch the bypass switch SW1 to bypass or connect the electrical connection between the alarm control panel CP and the security devices DV. Practically, the manual bypass switch SW1 is designed for temporary bypassing the electrical connection between the alarm control panel CP and the security devices DV during installation of the auxiliary control device 10.

The protecting circuitry 18, for preventing any high potential difference occurred between the input terminal units Z1*i* to Z8*i* and output terminal units Z1*o* to Z8*o* of the auxiliary control device 10, comprises a resistor R33 connected in parallel with a capacitor C32 and the two output switches 161, 162. The capacitor C32 is connected to a diode D31 which is connected in parallel with a resistor R33' and a capacitor C32', wherein the diode D31, the resistor R33' and the capacitor C32' are connected with the grounded line 101.

The display circuitry 19 can be installed to the auxiliary control device 10 for indicating each input zone detecting condition and the status of arming condition, standby condition or disarming condition by means of a plurality of LED units 191 to 198, 199, and 1910.

The driver control circuitry 20 is connected to the alarm buzzer DV2 and a plurality of predetermined electrical appliances DV5 of the commercial facility such as the lighting lamps outside the timer controlled monitoring zones, lighting of sign boards and other electrical office accessory equipment's for deactivating the buzzer DV2 and cutting off the power supply to the electrical appliances DV5 during the standby condition for energy saving.

The driver control circuitry 20 comprises a buzzer driver 21 and a relay driver 22. The buzzer driver 21 which is a driver integrate circuit, model no. 556, has a first foot 1 connected to two resistors R73, R74 which are connected to the power line 102 and the grounded line 101 respectively. A second foot 2 and a sixth foot 6 of the buzzer driver 21 are connected to the resistor R74 which is connected in parallel with a diode R71. A fourth foot 4 and a tenth foot 10 of the buzzer driver 21 are connected to the inputs of the logic gates AND1 and AND2. A thirteenth foot 13 of the buzzer driver 21 is connected to two resistors R71, R72 which are connected to the power line 102 and the grounded line 101 respectively. A twelfth foot 12 and a eighth foot 8 of the buzzer driver 21 are connected to the resistor R72 and the LED unit 199 of the display circuitry 19 via a diode D72. A seventh foot 7 is connected to the grounded line 101. The resistors R72 and R74 are connected to the grounded line 101 via two capacitors C71 and C72 respectively. The relay driver 22 comprises a relay RL2 which is connected in series between a ninth foot 9 of the buzzer driver 21 and the grounded line 101. A fifth foot 5 of the buzzer driver 21 and the relay driver 22 respectively form the positive and negative terminals 23 for connecting with the buzzer DV2, wherein the relay driver 22 and the negative terminal 23 are grounded via the grounded line 101. An output of the relay driver 22 forms an auxiliary control 24 for connecting with those electrical appliances DV5.

Accordingly, when the preset function time up, the counter circuitry 12 starts to compute the dynamic delay time and the security alarm system is switched to the standby condition by the auxiliary control device 10. At the same time, the driver control circuitry 20 deactivates the buzzer DV2 and the predetermined electrical appliances DV5 for energy saving purpose. After the standby condition, that is no activity being detected by the motion detectors DV1 for the dynamic delay time (5 to 30 minutes), the security alarm system is switched to arming condition by the auxiliary control device 10 automatically.

A remote control receiver 31 can be further connected to the clock module 121 and the input of the logic gate OR4 of the counter circuitry 12, so that the auxiliary control device 10 can be controlled manually by the remote control receiver 31. After close time, when the remote control receiver 31 is activated by a remote control transmitter outside the commercial facility, the door lock is released and then the auxiliary control device 10 is set to the dynamic delay status. The remote control receiver 31 will activate the clock module 121 of the counter circuitry 12 to generate pulse and to activate the timer counter 122 starting to compute the dynamic delay time, so as to set the security alarm system to the standby condition manually. A two channel remote control can be used to add an emergency holdup feature. Pressing channel two button can perform the above mentioned function, while pressing and holding both channels' buttons causes emergency holdup supposing the zone on the alarm control panel CP being programmed as emergency holdup zone (24-hour silent or audible). A digital keypad or a card control receiver can be used to replace the remote control receiver 31 for manually controlling the auxiliary control device 10.

A system status output drive 32 may also be connected to the output control circuitry 17 for reporting the arming condition of the security alarm system to a control center by a system status output DV6 which is connected to the system status output drive 32. The system status output DV6 will contact the control center and the police station through the phone line automatically for the owner when the security alarm system is activated by a burglar during the arming condition. The system status output drive 32 comprises a transistor Q7 which is connected to the output control circuitry 17 via two resistors R81 and R82. The two resistors R81 and R82 are connected to an input end and an output end of the transistor Q7 respectively.

Figure 4:
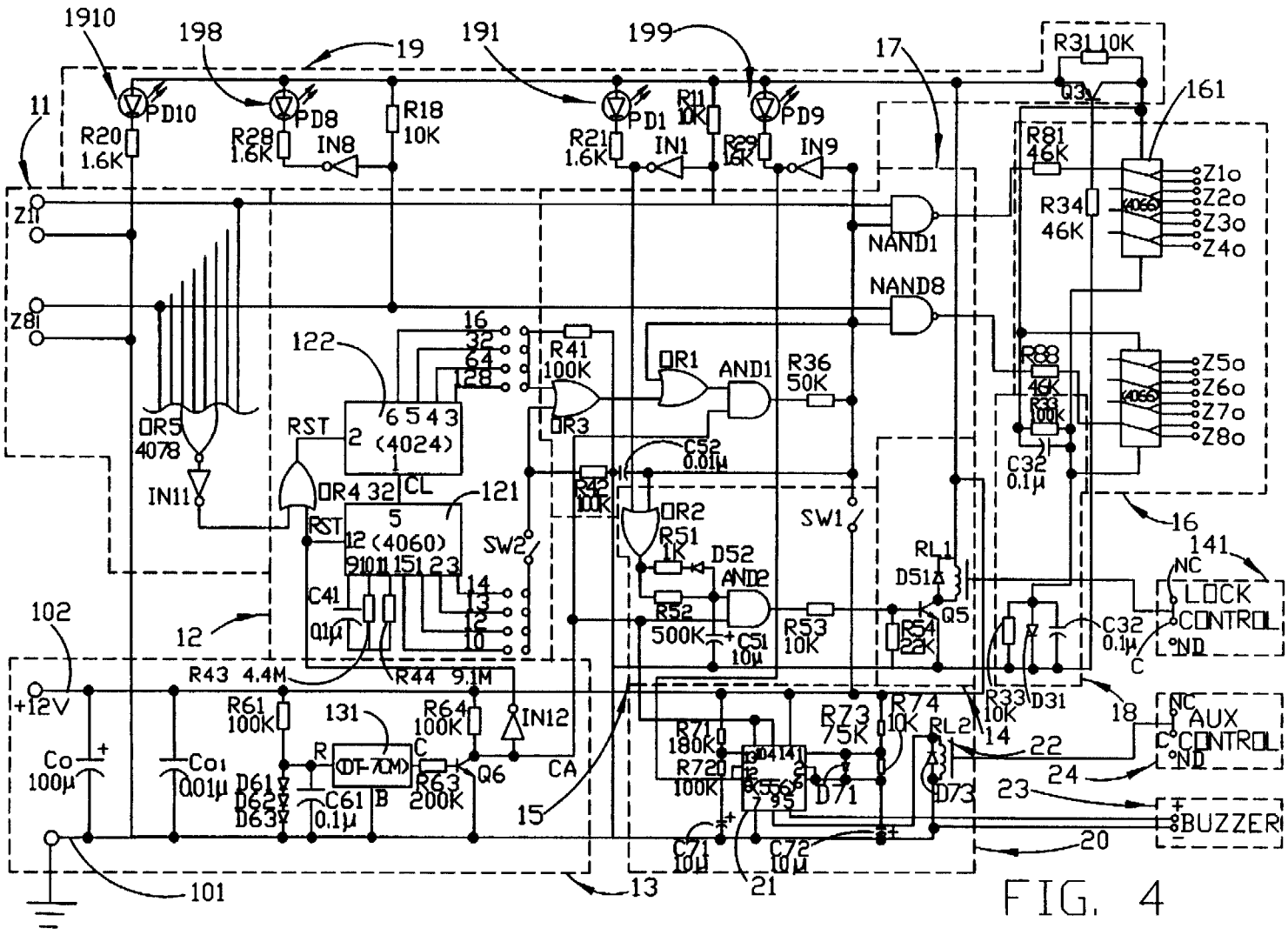
FIG. 4 is a circuit diagram illustrating the deletion of a remote control and a system status output drive from the control circuit shown in FIG. 3.

FIG. 4 illustrates an alternative circuit of the auxiliary control device 10 described above, in which the remote control receiver 31 and the system status output drive 32 are selectively deleted from the circuit. It means that the user may add various devices such as the remote control receiver 31 and the system status output drive 32 to the basic circuit as shown in FIG. 4. Moreover, in accordance with the actual need of the user, even the driver control circuitry 20 may also be deleted from the basic circuit of the auxiliary control device 10.

The installation of the auxiliary control device for a security alarm system according to the present invention is illustrated as follows.

Figure 6:
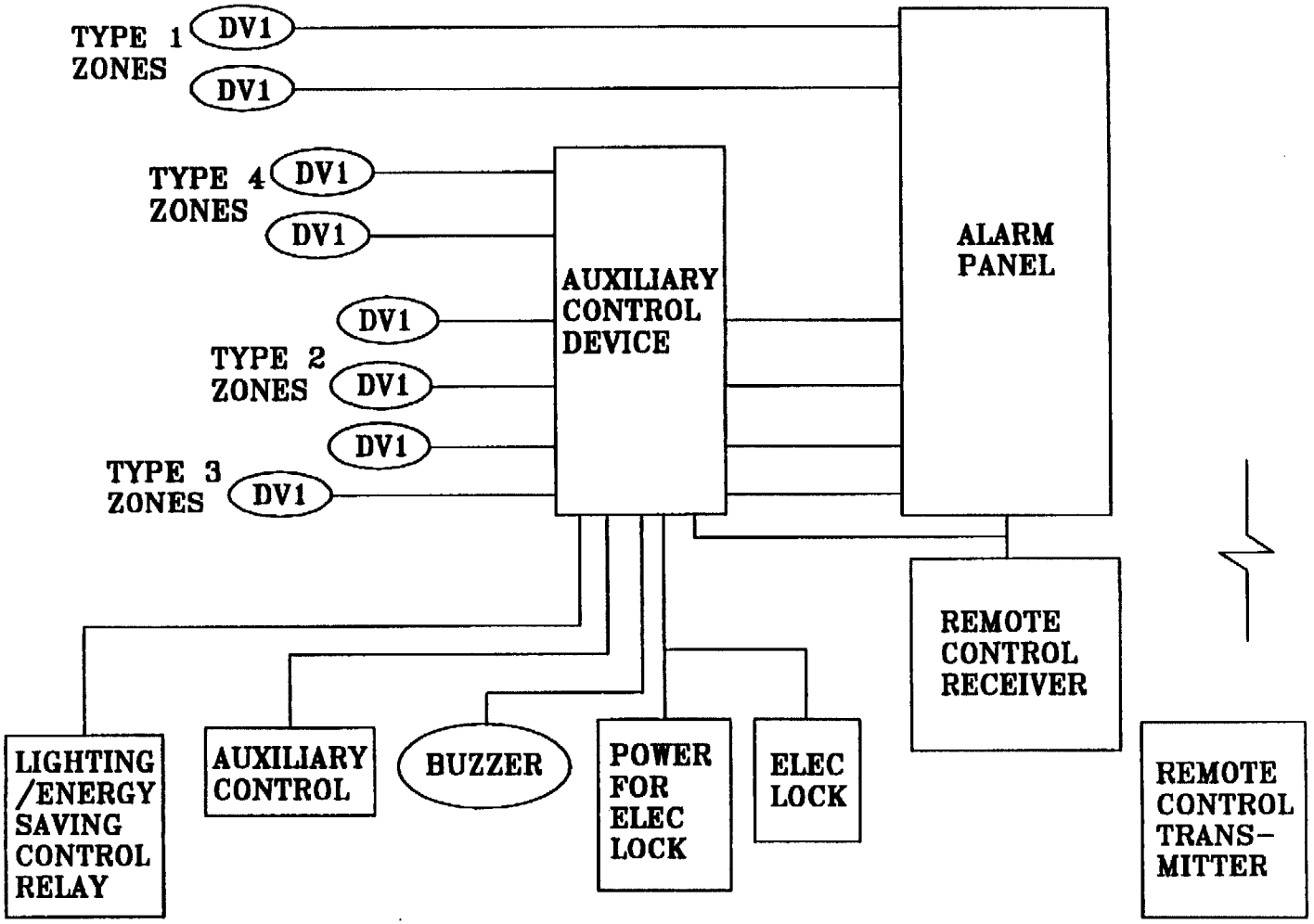
FIG. 6 is a block diagram illustrating the connection relationship between the auxiliary control device of the present invention and a security alarm system.

Referring to FIG. 6, the security alarm system installed with the auxiliary control device 10 of the present invention is illustrated. Before installing the auxiliary control device 10, distinct all the monitoring zones to the following four types of zone.

Type 1

MANUALLY CONTROLLED ZONES

The motion detectors of the manually controlled zones are connected directly to the alarm control panel CP. Those manually controlled zones are usually 24-hour armed. Any trigger of those zones would generate an alarm. The user can disarm those zones only by disarming the alarm control panel through the keypad. For example, some sensor loops, such as the money change machines in a coin-op laundry, are not time controlled. Those loops can be armed 24 hours a day and can only be armed or disarmed by entering codes through the keypad.

Type 2

TIMER-CONTROLLED ZONES

Timer-controlled zones are time related. They are connected to the zone input terminal units of the auxiliary control device 10 and the corresponding zones output from the output terminal units of the auxiliary control device 10 are connected to the alarm control panel CP. These are turned on/off by the auxiliary control device 10 after a dynamic delay time programmed by the user. The motion detectors are connected to this type of zones having dual functions. Besides the normal alarm detecting function, another function is to detect whether there is any customer inside the protected area after closing time. If one of the zones detects the presence of a customer, then the dynamic delay time is reset. This type of zone functions this way until the auxiliary control device 10 is turned on. If none of these zones is triggered for a period of dynamic delay time, the auxiliary control device 10 is then turned on and these zones function as normal alarm zones.

Type 3

DOOR LOCK CONTROL ZONE (INPUT ZONE 1)

The door lock control zone as the above type 2 zones plus that it will deactivate the door lock control relay when triggered.

Type 4

DYNAMIC DELAY RESET ZONES

The dynamic delay reset zones are connected to the input terminal units of the auxiliary control device 10, but the corresponding output terminal units from the auxiliary control device 10 are not connected to the alarm control panel CP. The only purpose of these zones is to reset dynamic timer during dynamic delay time.

The opening time (business hour) refers to the time at which the type 2 and type 3 zones are disarmed by the preprogrammed timer 131. After opening time, the door lock control 141 and the auxiliary control 24 are deactivated.

The closing time refers to the time at which the dynamic delay begins. After that time, the auxiliary control 24 is activated. The door lock control 141 is activated unless the type 3 zone is triggered, thus allowing the automatic exit while prohibiting entrance.

A force arming feature can be enabled or disabled by switching the force arming enable switch SW2. If it is enabled, after the close time, the force arming timer counter 122 is started. When the delay time is reached, the type 2 and type 3 zones are armed regardless the triggering of any type of zone. The force arming delay time can be set by a force arming timer set 123 (as shown in FIG. 2) for 30 minutes to 2 hours. The force arming feature can function only when the force arming enable switch SW2 is turned on. When the force arming enable switch SW2 is in an ON position, force arming feature is enabled. If it is enabled, when force arming delay time is reached after the closing time, the security alarm system is turned on regardless of the dynamic delay time.

The auxiliary control device 10 can be installed in either the cabinet of the alarm control panel CP if there is enough room, or in a separate cabinet close to the alarm control panel CP. Connect the type 3 zone to the door lock control designated the input terminal unit Z1*i*. The door sensor is connected to zone one functions as a door lock release detector, which, when triggered, will have the electric lock released for a few seconds. A motion detector with curtain lens is recommended to be installed in front of the door(s) as a door lock release sensor, which in this case also works as a burglary detector when the security alarm system is on.

The auxiliary control 24 can be used to perform special timing controls, for example lighting control. At the programmed closed time, the auxiliary control 24 is activated. At the open time, it is deactivated.

The system status output DV6 switches to ground when type 2 zones are turned on The maximum switchable current is 50 mA. The system status supervise the operation status of the auxiliary control device 10. One application example is to send out opening/closing (when time controlled zones are turned off/on) report.

A 12 VDC regulated power supply is required. The minimum supply current should be greater than 200 mA. The auxiliary power from the alarm control panel CP ban be used if the current rating satisfies the 200 mA requirement. If a separate power is used, connect a wire between the ground terminals on the alarm control panel CP and the auxiliary control device 10.

With the auxiliary control device 10 is installed to equipped with the security alarm system, the security alarm system can bypass the electrical connection between the alarm control panel CP and the security devices DV of the security alarm system during business hour and can also automatically set the security alarm system to the standby condition at the close time of the commercial facility.

The alarm control panel CP is programmed constantly in the arming condition. When the open time, which is preset in the timing circuitry 13, of the commercial facility such as a coin operating Laundromat is reached, the auxiliary control device 10 will be activated to bypass the electrical connection between alarm control panel CP and the security devices DV through the output control circuitry 17 so as to set the security alarm system to the disarming condition.

When the function (close) time which is also preset in the timing circuitry 13 is reached, the auxiliary control device 10 is set to the standby condition and processes the following functions automatically.

1. Continue to bypass the electrical connection between the alarm control panel CP and the security devices DV.
2. The timing circuitry 13 activates the counter circuitry 12 beginning to generate pulses and compute the programmed period of dynamic delay time, normally for 30 minutes.
3. Deactivate the buzzer DV2 and cut off the power supply to the predetermined electrical appliances DV5.
4. The door lock control 141 is activated to lock the entrance or exit doors.
5. The motion detectors DV1 located in the timer-controlled monitoring zones in the Laundromat and the door sensors DV4 near the exit doors are switched to function to detect whether there is any customer inside those timer-controlled monitoring zones after the close time. If any one of the motion detectors DV1 detects the presence of a customer, the dynamic delay time is then reset to compute initially again automatically. Besides, if the door sensor DV4 detects any customer near the exit door, the door lock control 141 is triggered to deactivate for releasing the locking of the door for a predetermined period of time, normally for 5 seconds to enable the customer to leave the Laundromat.
6. If none of the motion detectors DV1 of these timer-controlled monitoring zones is triggered for the period of dynamic delay time, i.e. when the Laundromat is empty, the auxiliary control device 10 is then turned on. At that moment, the counter circuitry 12 will send a signal to the output control circuitry 17 to release the bypassing of the electrical connection between the alarm control panel CP and the security devices DV, so that the security alarm system is in the arming condition until the next day open time is reached, and that those timer-controlled monitoring zones are functioned as normal alarm zones.

The auxiliary control device 10 of the present invention as disclosed above is designed basically according to a process for controlling the timing of switching a security alarm system to arming condition by monitoring the presence of customer or resident through those motion detectors of the security alarm system. The process comprises the following steps:

Disarming Condition (a) Bypass an electrical connection between an arming alarm control panel CP and a plurality of security devices DV of a security alarm system installed in a commercial facility when an open time of the commercial facility is reached, so as to set the security alarm system to a disarming condition during a predetermined period of time, i.e. the business hour.

Standby Condition (b) Compute a predetermined period of dynamic delay time when a preset close time of the commercial facility is reached, wherein the security alarm system is set to a standby condition.

(c) Bypass the electrical connection between the alarm control panel CP and some of the security devices DV, including a plurality of motion detectors installed in a plurality of predetermined timer-controlled monitoring zones, during the predetermined period of dynamic delay time.

(d) Deactivate a buzzer DV2 of the security alarm system during the predetermined period of dynamic delay time.

(e) Cut off the power supply of a plurality of predetermined electrical appliances DV5 of the commercial facility during the predetermined period of dynamic delay time.

(f) Lock a plurality of exit doors when the close time of the commercial facility is reached.

(g) Detect whether there is any customer inside the timer-controlled monitoring zones of the commercial facility by the motion detectors installed in the timer-controlled monitoring zones of the commercial facility during the predetermined period of dynamic delay time.

(h) Reset the predetermined period of dynamic delay time to compute initially again when any motion of the customer is detected by the motion detectors installed in the timer-controlled monitoring zones.

(i) Detect whether there is any customer near the locked exit door during the predetermined period of dynamic delay time.

(j) Unlock the exit door for a predetermined of time when any customer is detected by a door sensor installed near the exit door.

Arming Condition (k) Connect the electrical connection between the alarm control panel CP and the security devices DV by releasing the bypassing between the alarm control panel CP and the security devices DV, in order to set the security alarm system to an arming condition after the predetermined period of dynamic delay time is computed, i.e. none of the motion detectors DV1 of the timer-controlled monitoring zones detects any motion of any customer for the period of dynamic delay time.

What is claimed is:

1. An auxiliary control device of a security alarm system, which is installed in a commercial facility, having an alarm control panel and a plurality of security devices including a plurality of motion detectors, at least a door motion sensor and a plurality of electrical appliances, comprising an input driving circuitry for input connecting with said plurality of security devices of said security alarm system;

a counter circuitry for generating pulses mad computing a programmed period of predetermined dynamic delay time so as to set said security alarm system to a standby condition that when said motion detectors of said security alarm system detect a human activity occurred during said computing of said period of dynamic delay time, said counter circuitry is activated via the driving circuitry to reset and compute said period of dynamic delay time initially again;

a timing circuitry having a timer clock for sending a signal to activate said counter circuitry to begin said computing of said period of dynamic delay time at a function time preset in said timer clock;

a relay driver circuitry having a lock control for ensuring said door lock control to lock a door of said commercial facility during said standby condition;

a lock releasing circuitry for activating said door lock control to temporary release the locking of said door for a predetermined period of lock releasing time when a human activity is detected by said door motion sensor which is installed near said door during said standby condition;

an output circuitry for output connecting to said control panel of said security alarm system;

an output control circuitry for circuit bypassing the electrical connection between said control panel and said security devices during a predetermined period of opening time of said commercial facility and said standby condition, and for switching said security alarm system to an arming condition from said standby condition by releasing said circuit bypassing between said control panel and said security devices after said predetermined period of dynamic delay time is computed by said counter circuitry;

a protecting circuitry for preventing any high potential difference occurred between said input driving circuitry and said output circuitry of said auxiliary control device;

a driver control circuitry, which is connected to said buzzer and a plurality of electrical appliances of said commercial facility, for deactivating said buzzer and cutting a power supply to said electrical appliances during said standby condition for energy saving; and a display circuitry for indicating a plurality of status of said security alarm system;

whereby, before said function time, said auxiliary control device is activated to bypass said electrical connection between said alarm control panel and said plurality of security devices of said security alarm system installed in said commercial facility so as to set said security alarm system to a disarming condition during a predetermined period of time; and that when said function time preset in said timing circuitry is reached, said timing circuitry activates said counter circuitry beginning to generate pulses and compute said predetermined period of dynamic delay time, wherein said security alarm system is set to said standby condition;

during said standby condition, said output control circuitry of said auxiliary control device being activated for continuing to bypass said electrical connection between said alarm control panel and said security devices, said driver control circuitry deactivating said buzzer of said security alarm system and cutting off said power supply to said predetermined electrical appliances, said lock control of said relay driver circuitry being activated to lock said door, said motion detectors of said security alarm system detecting whether there is a human activity inside said commercial facility and resetting said predetermined period of dynamic delay time to compute initially again when said human activity is detected by said motion detectors, said door motion sensor of said security alarm system detecting whether there is a human activity near said locked door and unlocking said door for said predetermined period of lock releasing time by said lock releasing circuitry when said human activity is detected by said door sensor; and after said predetermined period of dynamic delay time being computed by said counter circuitry, said output control circuitry connecting said electrical connection between said alarm control panel and said security devices by releasing said bypassing between said alarm control panel and said security devices, in order to set said security alarm system to an arming condition.

2. An auxiliary control device, as recited in claim 1, in which said input driving circuitry comprises a predetermined number of input terminal units Z1*i* to Z8*i*, each of said input terminal units being connected in series to a logic gate OR8 and an anti-phase amplifier IN12 for input connecting with said security devices.

3. An auxiliary control device, as recited in claim 2, in which said counter circuitry comprises a logic gate OR4, a clock module and a timer counter, wherein said predetermined period of dynamic delay time is programmed into said timer counter, said logic gate OR4 having an input and an output, said input being connected to said anti-phase amplifier IN11 and said clock module, said output being connected to said timer counter.

4. An auxiliary control device, as recited in claim 3, in which said clock module is a pulse generator clock integrate circuit 4060 and said timer counter is a counter integrate circuit 4024 for computing said period of dynamic delay time programmed in said clock IC 4060.

5. An auxiliary control device, as recited in claim 4, in which said counter circuitry farther comprises a force arming enable switch SW2 connected between said clock module and said timer counter.

6. An auxiliary control device, as recited in claim 3, in which said timing circuitry further comprises a capacitor Co connected between a grounded line and a 12V power line, a capacitor C01 connected in parallel with said capacitor Co, a resistor R61 connected in series with three diodes D61, D62, D63 and in parallel with said capacitor C01, wherein said timer clock which is a digital programmable timer set DT-7 CM for presetting said function time of said counter circuitry has a R end connected to a capacitor C61, which is connected in parallel with said three diodes D61, D62, D63, and a B end connected to said grounded line, said timer clock further having a G end connected to a resistor R3 which is connected in series with a transistor Q6, wherein said transistor Q6 is connected to a resistor R64 and an input end of an anti-phase amplifier IN12, and that said resistor R64 is further connected to said power line, wherein an output end of said anti-phase amplifier IN12 is connected to said input of said logic gate OR4 and said clock module of said counter circuitry.

7. An auxiliary control device, as recited in claim 6, in which said lock releasing circuitry is a delay circuitry comprising a logic gate AND2 having an output connected to a resistor R53 which is connected with said transistor Q5 and said resistor R54 of said relay driver circuitry, an input of said logic gate AND2 being connected to said input of said anti-phase amplifier IN12 and a resistor R52 which is connected in parallel with a resistor R51 and a diode D52, in which said input of said diode D52 is connected to a capacitor C51 which is connected to said grounded line, and that said resistor R51 is connected to an output of a logic gate OR2.

8. An auxiliary control device, as recited in claim 7, in which said output circuitry comprises two output switches which are two solid state contact integrate circuits 4066 and provide a plurality of output terminal units Z1*o* to Z8*o* for connecting with said alarm control panel, said output control circuitry further comprising a plurality of resistors R81 to R88 connected with said plurality of output terminal units Z1*o* to Z8*o* of said two output switches respectively.

9. An auxiliary control device, as recited in claim 8, in which said output control circuitry comprises a plurality of logic gates NAND1 to NAND8, wherein each output of said logic gates NAND1 to NAND8 is connected to said plurality of output terminal units Z1*o* to Z8*o* via said plurality of resistors R81 to R82 respectively while each input of said logic gates NAND1 to NAND8 connecting to said input terminal units Z1*i* to Z8*i* of said input driving circuitry respectively, and that said inputs of said logic gates NAND1 to NAND8 are further connected in parallel with a logic gate OR1, a logic gate AND1 and a resistor R36, wherein an input of said logic gate OR1 is connected to a logic gate OR3 and an input of the logic gate AND1 is connected to said input of said logic gate AND2 of said lock releasing circuitry and an input of said anti-phase amplifier IN12 of the timing circuitry, a first input of said logic gate OR3 being connected to a resistor R41 while a second input of said logic gate OR3 being connected to a resistor R42, a capacitor C52 and a manual bypass switch SW1, in which both said resistors R41 and R42 are connected with said grounded line, and that said manual bypass switch SW1 is connected with said power line, said input of said logic gate OR2, said resistor R36, and said inputs of said logic gates NAND1 to NAND8 for manually controlling said bypassing said electrical connection between said alarm control panel and said security devices.

10. An auxiliary control device, as recited in claim 9, in which said protecting circuitry comprises a resistor R33 connected in parallel with a capacitor C32 and said two output switches, said capacitor C32 being connected to a diode D31 which is connected in parallel with a resistor R33' and a capacitor C32', wherein said diode D31, said resistor R33' and said capacitor C32' are connected with said grounded line.

11. An auxiliary control device, as recited in claim 10, in which said driver control circuitry comprises a buzzer driver and a relay driver, wherein said buzzer driver which is a driver integrate circuit 556 has a first foot connected with two resistors R73, R74 which are connected to said power line and said grounded line respectively, a second foot and a sixth foot of said buzzer driver being connected to said resistor which is connected in parallel with a diode R71, a fourth foot and a tenth foot of said buzzer driver being connected to said inputs of said logic gates AND1 and AND2, a thirteenth foot of said buzzer driver connected to two resistors R71, R72 which are connected to said power line and said grounded line respectively, a twelfth foot and a eighth foot of said buzzer driver being connected to said resistor R72 and said display circuitry via a diode D72, a seventh foot of said buzzer driver being connected to said grounded line, wherein said resistors R72 and R74 are connected to said grounded line via two capacitors C71 and C72 respectively, and that said relay driver is a relay RL2 which is connected in series between a ninth foot of said buzzer driver and said grounded line, a fifth foot of said buzzer driver and said relay driver forming a positive and a negative terminals for connecting with said buzzer of said security alarm system, wherein said relay driver and said negative terminal are grounded via said grounded line, an output of said relay driver forming an auxiliary control for connecting with said electrical appliances.

12. An auxiliary control device, as recited in claim 1, further comprising a remote control receiver which is connected to said counter circuitry for releasing said locked door after said function time of said auxiliary control device and setting to said standby condition.

13. An auxiliary control device, as recited in claim 11, further comprising a remote control receiver which is connected to said counter circuitry for releasing said locked door after said function time of said auxiliary control device and setting to said standby condition.

14. An auxiliary control device, as recited in claim 1, further comprising a system status output drive connected to said output control circuitry for reporting various system status to a control center by a system status output which is connected to said system status output drive.

15. An auxiliary control device, as recited in claim 11, further comprising a system status output drive connected to said output control circuitry for reporting various system status to a control center by a system status output which is connected to said system status output drive.

16. An auxiliary control device, as recited in claim 15, in which said system status output drive comprises a transistor Q7 which is connected to said output control circuitry via two resistors R81 and R82, wherein said two resistors R81 and R82 are connected to an input end and an output end of said transistor Q7 respectively.

17. A process for controlling a timing of switching a security alarm system to an arming condition, comprising the following steps of:

(a) bypassing an electrical connection between an arming alarm control panel and a plurality of security devices of a security alarm system installed in a commercial facility when an open time of said commercial facility is reached, so as to set said security alarm system to a disarming condition during a predetermined period of time;

(b) computing a predetermined period of dynamic delay time when a preset close time of said commercial facility is reached, wherein said security alarm system is set to a standby condition;

(c) bypassing said electrical connection between said alarm control panel and said security devices, including a plurality of motion detectors installed in a plurality of predetermined timer-controlled monitoring zones, during said predetermined period of dynamic delay time;

(d) deactivating a buzzer of said security alarm system during said predetermined period of dynamic delay time;

(e) cutting off a power supply of a plurality of predetermined electrical appliances of said commercial facility during said predetermined period of dynamic delay time;

(f) locking a plurality of exit doors when said close time of said commercial facility is reached;

(g) detecting a human activity occurred inside said timer-controlled monitoring zones of said commercial facility by said motion detectors installed in said timer-controlled monitoring zones of said commercial facility during said predetermined period of dynamic delay time;

(h) resetting said predetermined period of dynamic delay time to compute initially again when said human activity is detected by said motion detectors installed in said timer-controlled monitoring zones;

(i) detecting a human activity occurred near said locked exit door during said predetermined period of dynamic delay time;

(j) unlocking said exit door for a predetermined of lock releasing time when said human activity occurred near said locked exit door is detected by a door sensor installed near said exit door; and (k) connecting said electrical connection between said alarm control panel and said security devices by releasing said bypassing between said alarm control panel and said security devices, in order to set said security alarm system to an arming condition after said predetermined period of dynamic delay time is computed and none of said motion detectors of said timer-controlled monitoring zones detects said human activity for said period of dynamic delay time.

* * * * *